US006688918B2

(12) United States Patent
Wang et al.

(10) Patent No.: US 6,688,918 B2
(45) Date of Patent: Feb. 10, 2004

(54) SOCKET CONNECTOR FOR INSERTION OF AUDIO PLUG

(75) Inventors: Zhiqiang Wang, Kunsan (CN); GuangXing Shi, Kunsan (CN); XiaoLi Li, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/102,988

(22) Filed: Mar. 20, 2002

(65) Prior Publication Data

US 2002/0137395 A1 Sep. 26, 2002

(30) Foreign Application Priority Data

Mar. 20, 2001 (TW) ..... 90204162 U

(51) Int. Cl.[7] ..... H01R 17/18
(52) U.S. Cl. ..... 439/668; 439/79
(58) Field of Search ..... 439/668, 79, 947, 439/108, 188, 339, 669

(56) References Cited

U.S. PATENT DOCUMENTS 5,919,052 A * 7/1999 Ho ..... 439/83
6,056,602 A * 5/2000 Wu ..... 439/668
6,190,205 B1 * 2/2001 Wu
6,244,905 B1 * 6/2001 Wang ..... 439/668

* cited by examiner

*Primary Examiner*—P. Austin Bradley
*Assistant Examiner*—Phuongchi Nguyen
(74) *Attorney, Agent, or Firm*—Wei Te Chung

(57) ABSTRACT

A socket connector for insertion of an audio plug (95) comprises an insulating housing (10), a first terminal (30), a second terminal (50) and a third terminal (70) received within the housing, respectively. The housing has a mating surface (11) and a mating space (15) defined in the mating surface thereof for insertion of the plug. The terminals are positioned beside the mating space, respectively. The first terminal comprises a mating portion (35) for contacting with the plug and a contact portion (36). The second terminal comprises a contact portion contacting with the contact portion of the first terminal. The housing further comprises a first stopper (14) protruding into the mating space for preventing the mating portion of the first terminal from excessive deformation.

6 Claims, 6 Drawing Sheets

SOCKET CONNECTOR FOR INSERTION OF AUDIO PLUG

BACKGROUND OF THE INVENTION

1. Field of the Invention

The present invention relates to a socket connector, and particularly for a mini-type socket connector for insertion of an audio plug.

2. Description of Related Art

Referring to FIG. 6, a conventional socket connector is disclosed to provide electrical connection between two audio systems (not shown). The connector comprises an insulating housing 100, a first terminal 101, a second terminal 102 and a third terminal 103 received within the housing 100, respectively. The first terminal 101 includes a contact portion 104 for engaging with a contact portion 105 of the third terminal 103, thereby directly transmitting audio signals to an inner audio player (not shown) which is electrically connected with the third terminal 103. The contact portion 104 of the first terminal 101 is pushed downward by an inserted audio plug and disengages from the contact portion 105 of the third terminal 103, thereby transmitting audio signals from the first terminal 101 to an outer audio player (not shown) by the audio plug 95. It is noted that the contact portion 104 of the first terminal 101 is required to have excellent resiliency without permanent deformation to assure engagement with the plug when the plug is inserted into the connector. However, this increases the difficulty for the contact portion 104 to return to its original position because so large a contact force is apt to permanently deform the contact portion, particularly when the plug is inserted slantways.

To solve above-mentioned problem, Taiwan Patent Application No. 82207507 discloses a design that increases the length of the contact portion of the first terminal so that the contact portion can have excellent resiliency. However, a disadvantage still exists, that is, the longer contact portion occupies more space in the connector, that increasing the difficulty of miniaturization development trend of the connector.

Accordingly, Taiwan Patent Application No. 85218465 provides a spring assembled to the contact portion of the terminal. However, the costs of such a spring is quite high because of its own capability requirement and this also increases the assembling costs of the connector.

SUMMARY OF THE INVENTION

Accordingly, the object of the present invention is to provide a socket connector capable of preventing a contact portion of a terminal of the connector from permanent deformation when an audio plug is inserted into the connector.

In order to achieve the object set forth, a socket connector for insertion of an audio plug of the present invention comprises an insulating housing, a first terminal, a second terminal and a third terminal received within the housing, respectively. The housing has a mating surface and a mating space defined in the mating surface thereof for insertion of the plug. The terminals are positioned beside the mating space, respectively. The first terminal comprises an arced mating portion engaging with the plug, and a contact portion at a free end of the mating portion. The second terminal comprises a contact portion contacting with the contact portion of the first terminal. The housing further comprises a stopper protruding into the mating space.

When the plug is inserted into the connector, the mating portion of the first terminal is pushed to move toward the stopper and being stopped by the stopper, thereby preventing the mating portion of the first terminal from permanent deformation.

Other objects, advantages and novel features of the invention will become more apparent from the following detailed description of the preferred embodiment when taken in conjunction with the accompanying drawings.

DETAILED DESCRIPTION OF THE INVENTION

Figure 1:
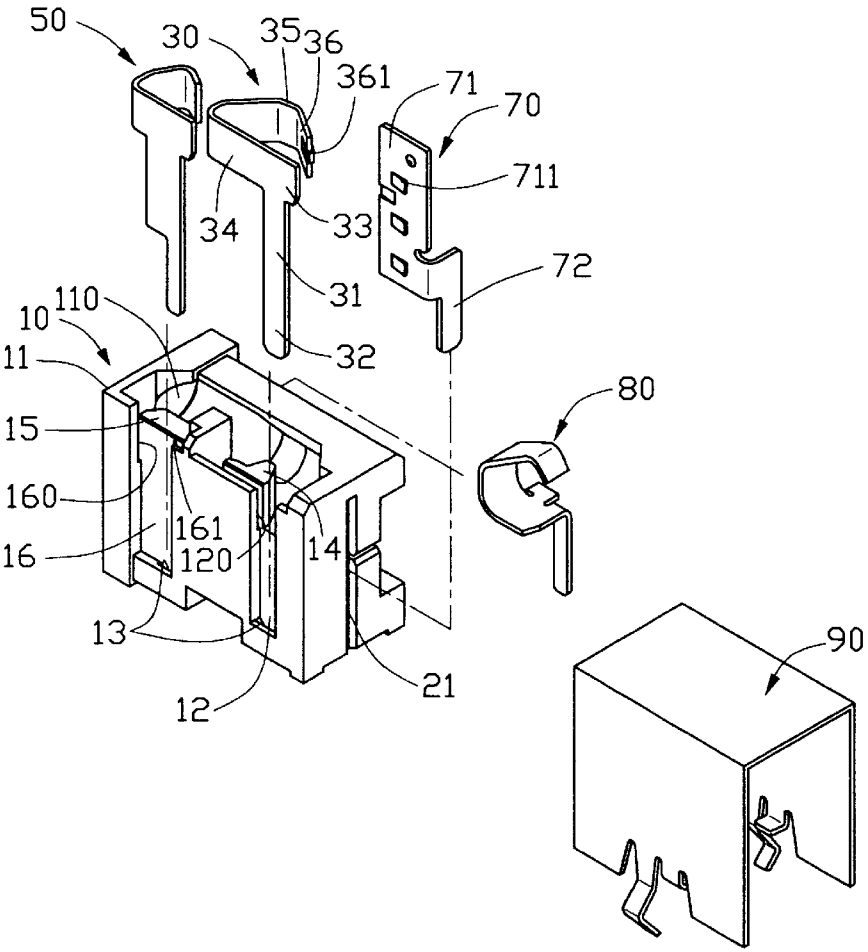
FIG. 1 is an exploded view of a socket connector of the present invention.

Reference will now be made to the drawing figures to describe the present invention in detail.

Figure 2:
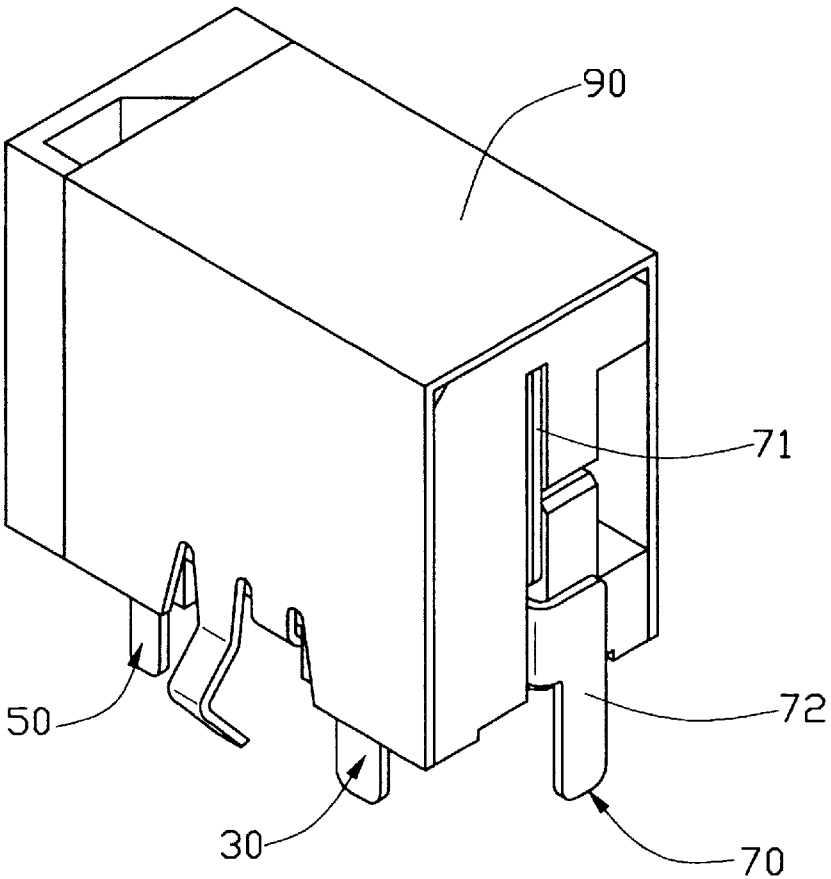
FIG. 2 is an assembled view of the connector of FIG. 1.

Referring to FIGS. 1 and 2, a socket connector of the present invention comprises a rectangular insulating housing 10, a plurality of signal terminals 30, 50, 70, 80 and a metallic shell 90. The housing 10 has a mating surface 11 and a mating space 110 defined in the mating surface 11 for insertion of an audio plug 95 (shown in FIG. 3). The housing 10 defines a recess 12 in a side surface thereof and a first receiving slot 120 in left of and in communicating with the recess 12. The housing 10 further defines two through holes 13 in communicating with the recesses 12, 16 and a bottom surface of the housing 10. The housing 10 also defines a recess 16 in the side surface thereof. The recess 16 has a similar configuration with the recess 12. The housing 10 defines a second receiving slot 161 in communicating with the recess 16 and the bottom surface of the housing 10. The housing 10 also defines a narrow gap 21 in another side surface thereof. Also referring to FIG. 3, the housing 10 further comprises a V-shaped first stopper 14 in the mating space 110 and near the recess 12, and a stepped second stopper 15 spaced with the first stopper 14. The first stopper 14 includes an arced supporting end 141 at a top thereof. The second stopper 15 has a first surface 151 and a second surface 152 parallel to the first surface 151.

The signal terminals comprise a first terminal 30, a second terminal 50, a third terminal 70 and a fourth terminal 80. The first terminal 30 has a main body 31, an insert leg 32 downwardly extending from the main body 31, and a protruding portion 33 protruding laterally from a top of the main body 31. The first terminal 30 forms a transmitting portion 34 at the top of the main body 31 and opposite to the protruding portion 33. An arced mating portion 35 is integrally formed with the transmitting portion 34 for contacting with the plug 95. The first terminal 30 further forms a contact portion 36 at a free end of the mating portion 35. The contact portion 36 forms a first protruding point 361 thereon. The second terminal 50 has a similar configuration with the first terminal 30. The difference between them is that the second terminal 30 has no such a contact portion 36 as the first terminal 30. The third terminal 70 has a rectangular contact portion 71 having a plurality of second protruding points 711 thereon. The third terminal 70 further includes an insert leg 72 perpendicularly extending from a side edge of a bottom of the contact portion 71.

The first terminal 30 is retained within the housing 10, wherein the main body 31 tightly abut an inner surface of the recess 12, the insert leg 32 extends through one of the through holes 13 and protrudes beyond the bottom surface of the housing 10, and the transmitting portion 34 is securely retained within the first receiving slot 120. The second terminal 50 is assembled within the housing 10 similar to the first terminal 30; the difference is that a protruding portion (not labeled) of the second terminal 50 is retained within the second receiving slot 161 and the body portion (not labeled) tightly abut an inner surface of the recess 16. The contact portion 71 of the third terminal 70 is retained within the gap 21 by engaging the second protruding points 711 to an inner surface of the gap 21. The contact portion 36 of the first terminal 30 contacts with the contact portion 71 of the third terminal 70. The first protruding point 361 securely engages with the contact portion 71.

Figure 3:
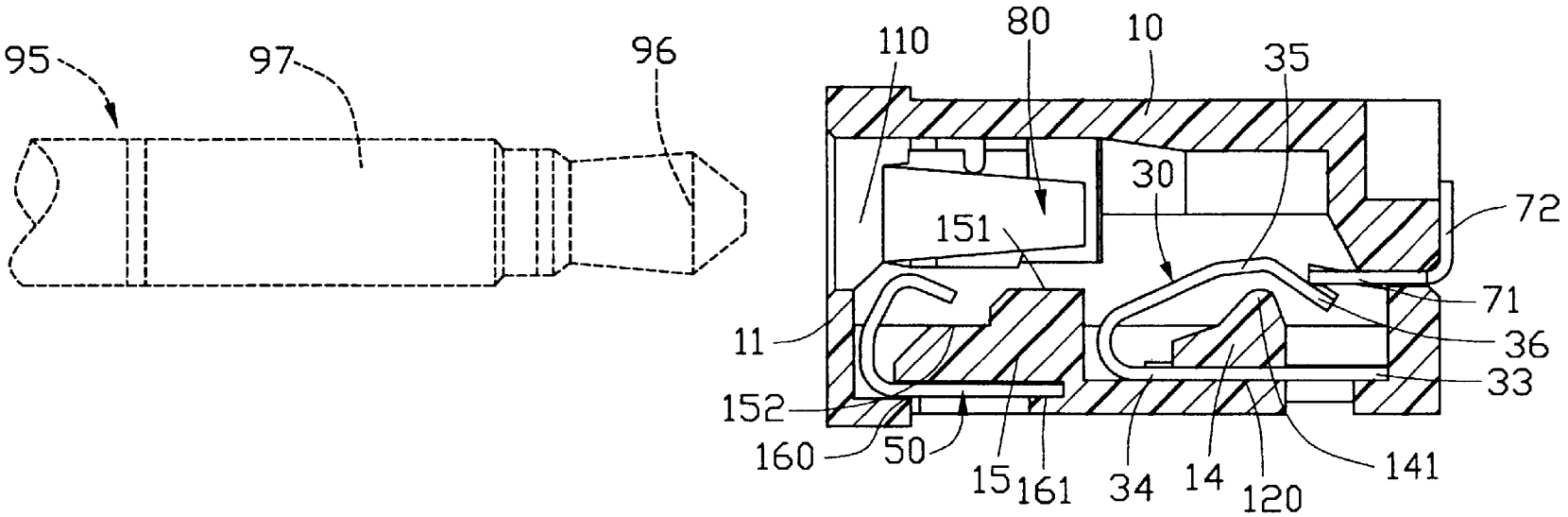
FIG. 3 is a cross-sectional view of the connector of FIG. 2 wherein an audio plug shown in broken lines is to be being inserted into the connector.
Figure 4:
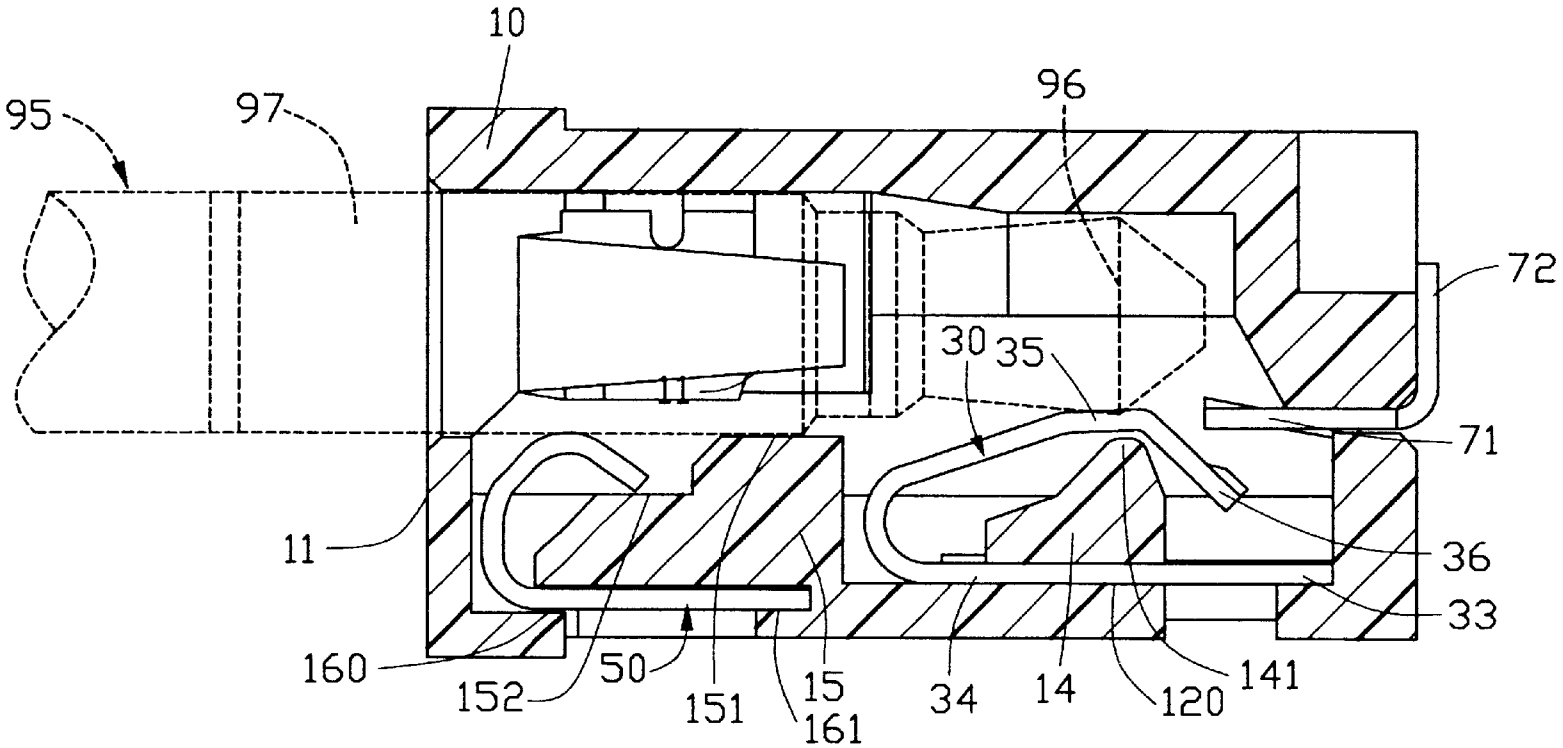
FIG. 4 is similar to FIG. 3 wherein the audio plug is correctly inserted into the connector.

Referring to FIGS. 3 and 4, the audio plug 95 has a first contact portion 96 at a front end thereof and a second contact portion 97 at a rear end thereof. When the plug 95 is correctly, i.e. in a horizontal direction, inserted into the connector, as shown in FIG. 3, the first contact portion 96 pushes downward the mating portion 35 of the first terminal 30 resulting that the contact portion 36 of the first terminal 30 disengages from the contact portion 71 of the third terminal 70. The supporting end 141 of the first stopper 14 does not contact with the mating portion 35 of the first terminal 30, the first surface 151 of the second stopper 15 upwardly abuts against a bottom of the second contact portion 97 of the plug 95.

Figure 5:
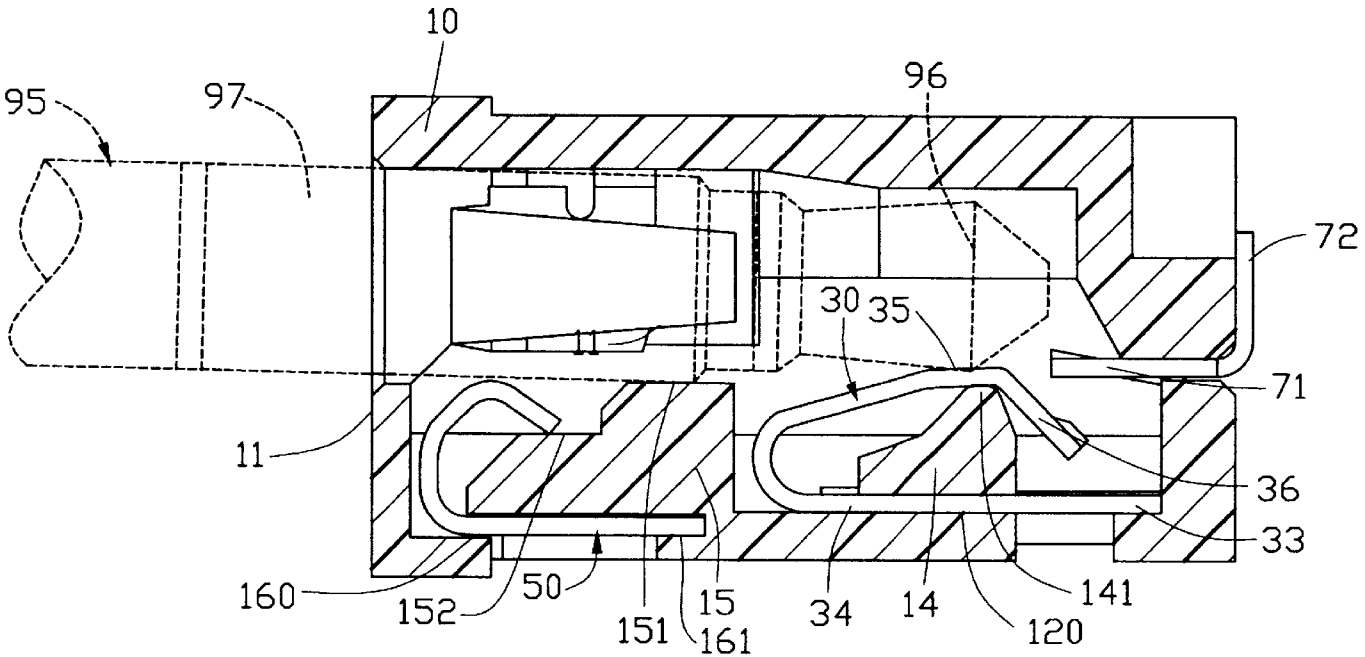
FIG. 5 is similar to FIG. 4 wherein the audio plug is slantways inserted into the connector.
Figure 6:
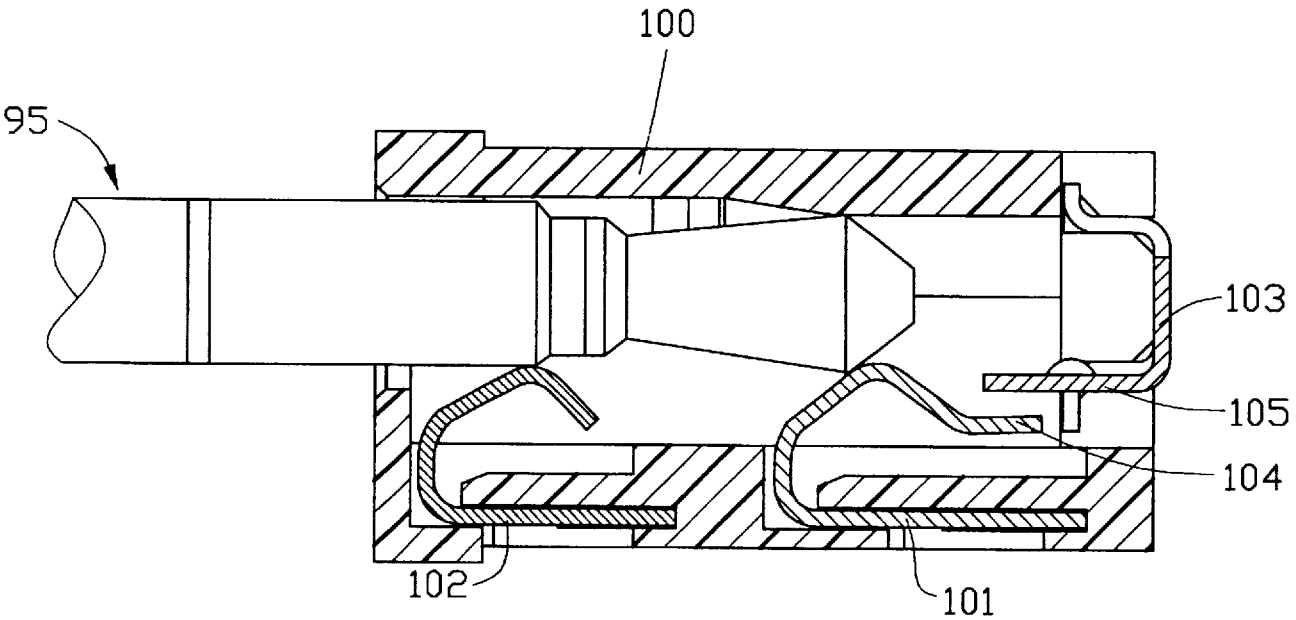
FIG. 6 (PRIOR ART)
FIG. 6 is a cross-sectional view of a conventional socket connector wherein an audio plug is partially inserted into the connector.

Referring to FIG. 5, if the plug is incorrectly, i.e. in a slantways, inserted into the socket connector, the mating portion 35 of the first terminal 30 is pushed downward by the first contact portion 96 of the plug 95 and moves toward the first stopper 14 until it is stopped by the supporting end 141 of the first stopper 14, thereby preventing the mating portion 35 of the first terminal 30 from permanent deformation. Thus, the deformation of the mating portion 35 of the first terminal 30 can be controlled within a predetermined degree. When the plug 95 is withdrawn, the mating portion 35 of the first terminal 30 returns to its original position and electrically contacts with the contact portion 71 of the third terminal 70. Similarly, a free end (not labeled) of the second terminal 50 is stopped by the second surface 152 of the second stopper 15 when the second terminal 50 is excessively pushed by the second contact portion 97 of the plug 95, thereby controlling the deformed range of the second terminal 50.

A first advantage of the present invention is that the terminals can be made of common material such as phosphor bronze which has lower costs.

A second advantage of the present invention is that the resilient contact portions of the terminals are relatively shorter so that they occupy less space in the connector relative to the cited art to follow the miniaturization trend of the connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A socket connector for mating with an audio plug, comprising:

an insulative housing having a mating surface and a mating space defined in the mating surface for insertion of the plug, the housing integrally forming at an inner wall thereof a first stopper protruding into the mating space;

a first terminal and a second terminal (70) assembled within the housing, respectively, the first terminal including a mating portion and a contact portion, the second terminal including a contact portion engaged with the contact portion of the first terminal;

wherein the mating portion of the first terminal moves toward the first stopper when the audio plug is inserted into the connector and finally the further movement of the mating portion of the first terminal is stopped by the first stopper thereby preventing the mating portion of the first terminal from permanent deformation, and wherein the first stopper comprises a supporting end at a top thereof for abutting the mating portion of the first terminal.

2. The socket connector as claimed in claim 1, wherein the contact portion of the first and second terminals disengage with each other when the audio plug is inserted into the connector.

3. The socket connector as claimed in claim 1, wherein the connector comprises a metallic shell enclosing outer surfaces of the housing.

4. The socket connector as claimed in claim 1, wherein the housing comprises a second stopper spaced from the first stopper, the second stopper having a first surface and a second surface parallel to the first surface, the connector comprising a third terminal (50) received within the housing, a movement of a free end of the third terminal being stopped by the second surface of the second stopper.

5. The socket connector as claimed in claim 4, wherein the housing defines a second recess receiving the third terminal therein.

6. The socket connector as claimed in claim 5, wherein the connector further comprises a fourth terminal received in the housing.

* * * * *